US005601900A

United States Patent [19]

Doscher

[11] Patent Number: 5,601,900

[45] Date of Patent: Feb. 11, 1997

[54] ANTI-SKID MAT

[76] Inventor: Herbert Doscher, 499 Davie St., Westbury, N.Y. 11590

[21] Appl. No.: 462,206

[22] Filed: Jun. 5, 1995

[51] Int. Cl.[6] ..... E01C 11/24; E01C 15/00; B32B 3/16

[52] U.S. Cl. ..... 428/149; 428/195; 428/143; 428/150; 428/44; 428/492; 428/134; 428/131; 404/19; 404/32; 404/35; 238/14

[58] Field of Search ..... 428/195, 143, 428/149, 150, 44, 492, 134, 131; 404/19, 32, 35; 238/14

[56] References Cited

U.S. PATENT DOCUMENTS

| | | | |
|---|---|---|---|
| 3,335,645 | 8/1967 | Eisenberg | 238/14 |
| 4,223,835 | 9/1980 | Witt et al. | 238/14 |
| 4,328,274 | 5/1982 | Tarbutton et al. | 428/149 |
| 4,501,783 | 2/1985 | Hiragami et al. | 428/147 |
| 4,596,731 | 6/1986 | Cudmore et al. | 428/134 |
| 4,931,330 | 6/1990 | Stier et al. | 428/40 |
| 4,998,670 | 3/1991 | Peterson | 238/14 |
| 5,094,902 | 3/1992 | Haenggi et al. | 428/150 |
| 5,204,159 | 4/1993 | Tan | 428/143 |

*Primary Examiner*—William Watkins
*Attorney, Agent, or Firm*—Michael I. Kroll

[57] ABSTRACT

An anti-skid mat for placement upon a slippery support surface comprising a resilient matrix sheet member having a top surface and a bottom surface. An abrasive structure on the bottom surface of the resilient matrix sheet member is for preventing slippage of the resilient matrix sheet member on the slippery support surface. This forms a safe walkway for a person, when the person steps upon the top surface of the resilient matrix sheet member.

1 Claim, 2 Drawing Sheets

ANTI-SKID MAT

BACKGROUND OF THE INVENTION

1. Field of the Invention

The instant invention relates generally to slip-resistant sheet materials and more specifically it relates to an anti-skid mat.

2. Description of the Prior Art

Numerous slip resistant sheet materials have been provided in prior art. For example, U.S. Pat. Nos. 4,328,274 to Tarbutton et al.; 4,931,330 to Stier et al.; 5,094,902 to Haenggietal and 5,204,159 to Tan all are illustrative of such prior art. While these units may be suitable for the particular purpose to which they address, they would not be as suitable for the purposes of the present invention as heretofore described.

TARBUTTON, KENT S.

ZEMBE, RONALD O.

TRANSPARENT FRICTION SURFACE SHEET MATERIAL

U.S. Pat. No. 4,328,274

A friction surface sheet material which may be adherently bonded to the patterned surface of a substrate which permits the visual observation of such pattern when attached. The friction surface sheet material comprises a backing layer formed of a dimensionally stable polymeric film such as polyethylene terephthalate. A first and second coating of the first and second transparent binder material adherently bond a multitude of minute transparent glass particles uniformly dispersed over the upper major surface of the backing layer, with the tops of the glass particles projecting above the binder coating to provide a friction surface, and the bottom major surface of the backing layer has thereon a layer of transparent pressure-sensitive adhesive. The glass particles may be glass spheres or fragments obtained by fracturing larger particles of glass. The transparent sheet material of the invention is particularly suited for applying to the surface of skate boards, particularly those which have ornamental surfaces which the owners desire not to obscure.

STIER, SAM S.

KAUFMAN, ROBERT E.

PREFABRICATED SLIP-RESISTANT SURFACE COATING

U.S. Pat. No. 4,931,330

The invention relates to a prefabricated, slip-resistant surface coating which comprises a sheet member having a film on its surface. The film is embedded therein with a plurality of finely divided abrasive particles. This coating can be adapted to make a bathtub surface slip-resistant.

HAENGGI, ROBERT A.

LAIRD, JAMES A.

SKID-RESISTANT SURFACE MARKING MATERIAL

U.S. Pat. No. 5,094,902

A skid-resistant surface marking material is disclosed. The skid-resistant, surface marking material comprises a polymer matrix phase and a plurality of opaque ceramic spheroids partially embedded in and protruding from the top surface of the matrix layer. The ceramic spheroids have rounded surfaces and no substantial points.

TAN, DOMINGO K. L.

DEFORMABLE SLIP-FREE ANTI-SKID PADS FOR SNOW AND ICE

U.S. Pat. No. 5,204,159

A deformable slip-free, anti-skid pad comprising a bottom surface having a plurality of spikes slightly extending vertically from recessed areas of the bottom surface and a top surface comprising a resilient material having imbedded therein particles of abrasive materials.

SUMMARY OF THE INVENTION

A primary object of the present invention is to provide an anti-skid mat that will overcome the shortcomings of the prior art devices.

Another object is to provide an anti-skid mat that contains a safe walking surface, which can be placed over a slippery support surface, such as on ice, snow, wet floors and the like.

An additional object is to provide an anti-skid mat that may be made from recycled materials, is reusable, can be rolled up for storage and can be cleaned with little effort.

A further object is to provide an anti-skid mat that is simple and easy to use.

A still further object is to provide an anti-skid mat that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
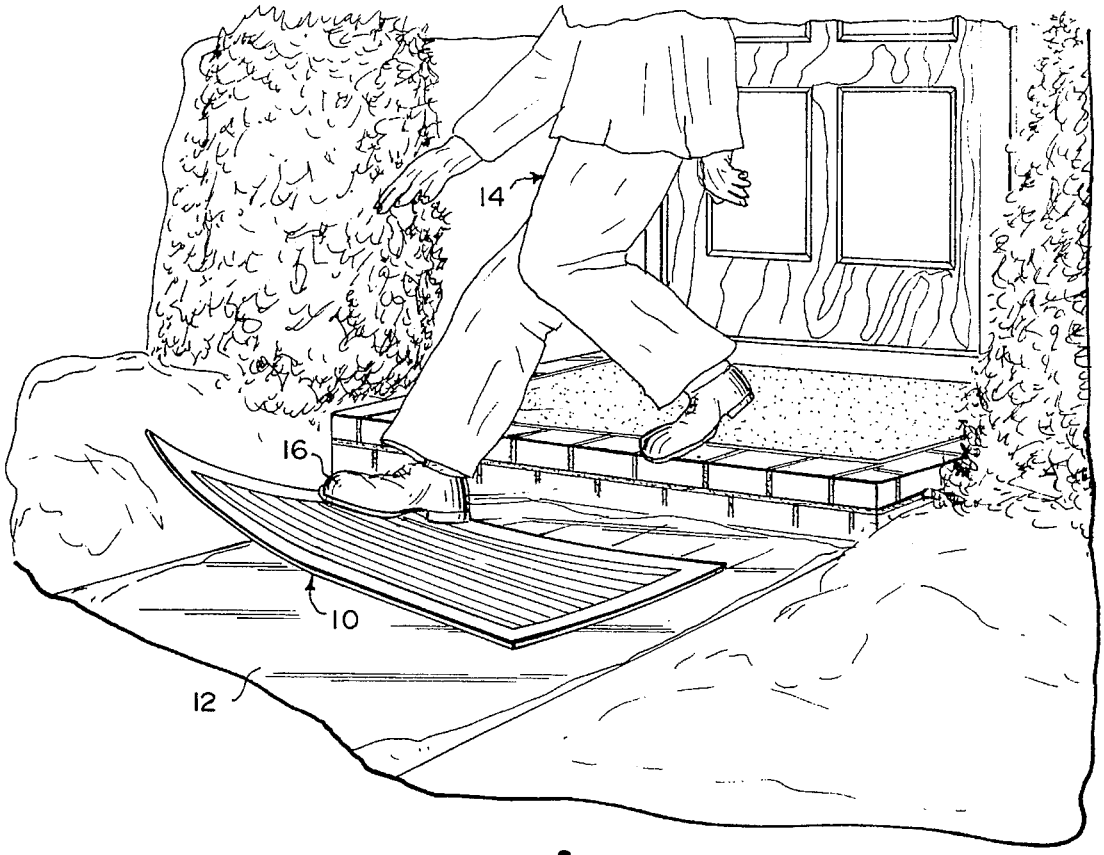
Fig-1 (PRIOR ART)
FIG. 1 is a perspective view of the prior art, showing a person stepping onto a conventional floor mat which is sliding upon a slippery walkway.

Turning now descriptively to the drawings, in which similar reference characters denote similar elements throughout the several views, FIG. 1 illustrates the prior art which is a conventional mat 10 placed upon a slippery support surface 12. A person 14 is shown stepping upon the mat 10 and the mat 10 sliding out from under the foot 16 which can cause injury to the person 14.

FIGS. 2 through 6 show the invention being an anti-skid mat 18 for placement upon the slippery support surface 12, comprising a resilient matrix sheet member 20 having a top surface 22 and a bottom surface 24. A structure 26 on the bottom surface of the resilient matrix sheet member is for preventing slippage of the resilient matrix sheet member on the slippery support surface. This forms a safe walkway for a person, when the person steps upon the top surface of the resilient matrix sheet member.

The resilient matrix sheet member 20 is a broad flat piece of elastic material 28. The resilient matrix sheet member 20 is made out of a rubber substance 30.

The slippage preventing structure 26 is a plurality of gripping granules 32 embedded into the bottom surface 24 of the resilient matrix sheet member 20. The gripping granules 32 are spaced apart and extend partially out of the bottom surface 24, to engage with the slippery support surface 12. The gripping granules 32 are embedded throughout the resilient matrix sheet member 20, so as to prevent the gripping granules 32 from wearing off of the bottom surface 24. The gripping granules 32 are each fabricated out of a silicon carbide substance 34.

Figure 2:
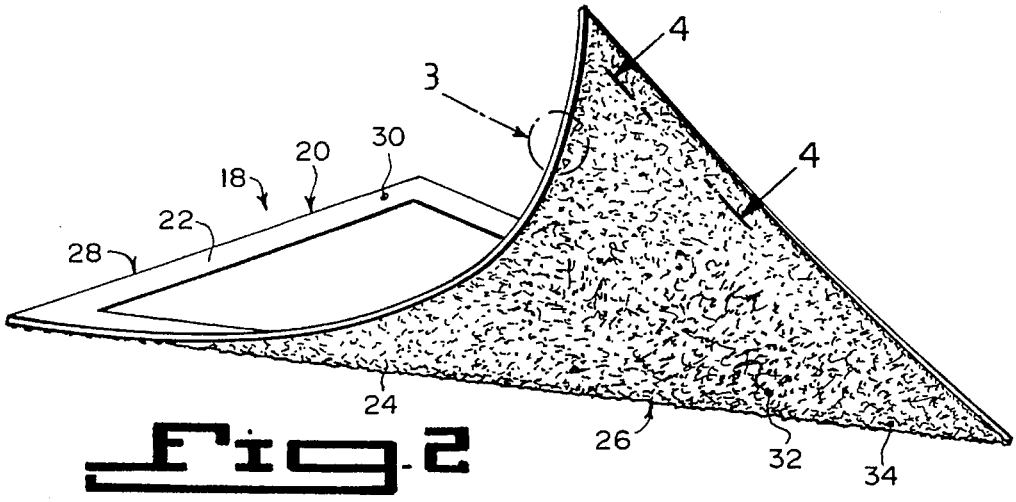
FIG. 2 is a perspective view of a first embodiment of the instant invention with one corner turned up.
Figure 3:
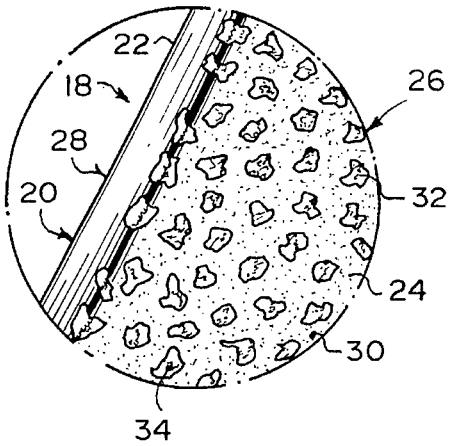
FIG. 3 is an enlarged perspective view of the area as indicated by arrow 3 in FIG. 2, showing the granules in greater detail.
Figure 4:
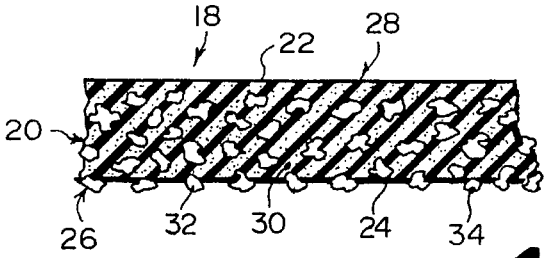
FIG. 4 is an enlarged cross sectional view taken along line 4—4 in FIG. 2, showing the granules imbedded throughout the resilient matrix sheet member.
Figure 5:
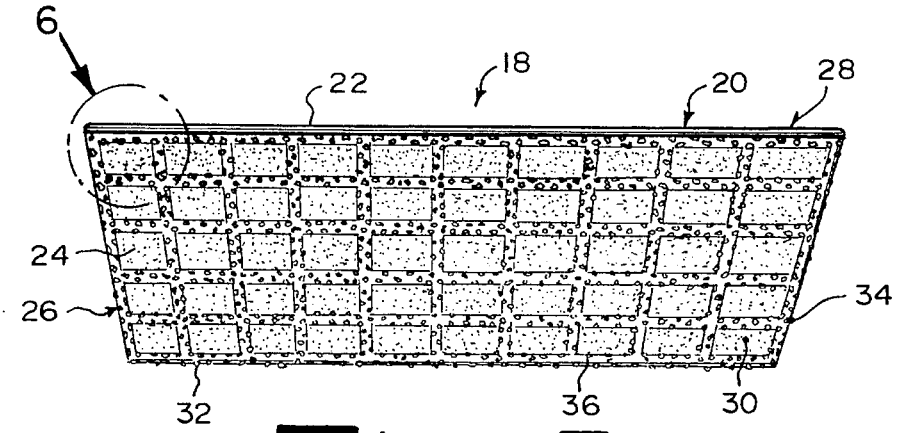
FIG. 5 is a bottom perspective view of a second embodiment of the instant invention.
Figure 6:
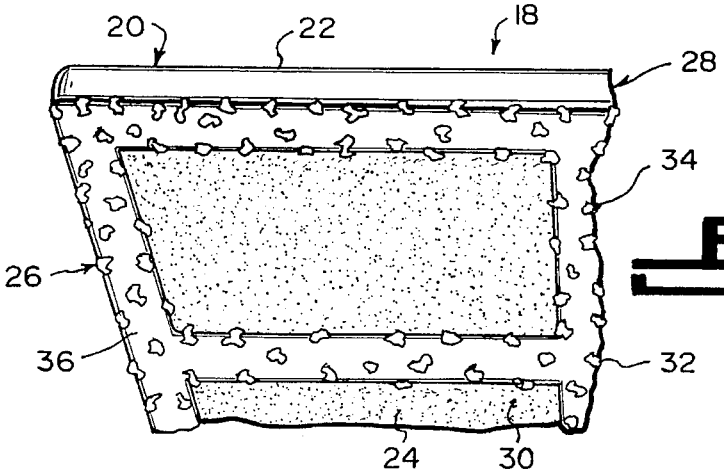
FIG. 6 is an enlarged perspective view of the area as indicated by arrow 6 in FIG. 5, showing the granules in greater detail.

As shown in FIGS. 2 to 4, the slippage preventing structure 26 cover substantially all of the bottom surface 24 of the resilient matrix sheet member 20. In FIGS. 5 and 6, the slippage preventing structure 26 is formed in a grid pattern 36, substantially along all of the bottom surface 24 of the resilient matrix sheet member 20. The grid pattern 36 will help make the anti-skid mat 18 more flexible to conform to the contour of irregular ground surfaces.

The resilient matrix sheet member 20 can be dimensioned to permit it to cover all of the slippery support surface 12, which can be a sidewalk that is wet, covered with ice, snow or mud. The gripping granules 32 each have irregular shaped edges, to better engage with the slippery support surface 12.

The anti-skid mat 18 can be made in long rolls, so that when spread out it will cover longer slippery support surfaces 12. The anti-skid mat 18 can also be made in narrow rolls, so that when rolled up the anti-skid mat 18 can be put under motor vehicle wheels in lieu of sand or other traction devices.

The anti-skid mat 18 can be used on sidewalks, on stairs, in ice rinks, in driveways, for car traction, at work areas, at emergency scenes such as around fire encnes and ambulances in icy weather and on handicapped ramps. The anti-skid mat 18 can be used by itself or in multiple layers for different situations. It also can be made in many shapes and sizes, such as mats, runners, treads, strips or large sheets. The anti-skid mat 18 can be easily customized and personalized with words and pictures printed on the top surface 22.

The anti-skid mat 18 will eliminate messy sand, gravel or salt from being tracked indoors, while helping to prevent ground contamination from salt being used. The anti-skid mat 18 may be made from recycled materials, therefore being environmentally friendly. It is reusable, easy to use, store and easily cleaned, especially for elderly people.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is desired to be protected by Letters Patent is set forth in the appended claims:

1. An anti-skid mat of extended length for placement upon a slippery support surface comprising:

a) a one piece resilient matrix sheet member of rubber elastic material having a top surface and a bottom surface and conforming means to help said sheet member be more flexible to conform to the contour of irregular ground surfaces; and b) means on said bottom surface of said resilient matrix sheet member for preventing slippage of said resilient matrix sheet member on said slippery support surface comprising a plurality of gripping granules of a silicon carbide substance embedded into said bottom surface spaced apart and extending partially out of said bottom surface to engage said slippery support surface, said conforming means consisting of said means on said bottom surface being formed into a grid pattern, thereby forming a safe walkway for a person, when the person steps upon said top surface of said resilient matrix sheet member.

* * * * *